US007540089B2

(12) United States Patent
Oswald et al.

(10) Patent No.: US 7,540,089 B2
(45) Date of Patent: Jun. 2, 2009

(54) ELECTRIC SHAVER

(75) Inventors: Mathias Oswald, Werndorf (AT); Andreas Hillenmeier, Ingelheim (DE)

(73) Assignee: Payer International Technologies GmbH & Co. KG, St. Bartholoma (AT)

( * ) Notice: Subject to any disclaimer, the term of this patent is extended or adjusted under 35 U.S.C. 154(b) by 0 days.

(21) Appl. No.: 10/417,030

(22) Filed: Apr. 16, 2003

(65) Prior Publication Data

US 2003/0226259 A1 Dec. 11, 2003

(30) Foreign Application Priority Data

Apr. 17, 2002 (AT) ..... GM248/2002

(51) Int. Cl.
*B26B 19/00* (2006.01)

(52) U.S. Cl. ..... 30/43.1; 30/43.2; 30/43.8; 30/43.91

(58) Field of Classification Search ..... 30/43.1, 30/43.2, 43.6, 43.92, 43.91, 43.8
See application file for complete search history.

(56) References Cited

U.S. PATENT DOCUMENTS 3,999,291 A * 12/1976 Boer ..... 30/43.92
RE30,857 E * 2/1982 Tyler ..... 30/43.5
4,631,825 A * 12/1986 Kuriyama et al. ..... 30/43.92
5,046,249 A * 9/1991 Kawara et al. ..... 30/45
5,299,354 A * 4/1994 Metcalf et al. ..... 30/45
5,398,412 A * 3/1995 Tanahashi et al. ..... 30/43.92
5,653,026 A * 8/1997 Tezuka ..... 30/43.92
6,381,849 B2 * 5/2002 Eichhorn et al. ..... 30/43.92
6,430,813 B2 * 8/2002 Muraguchi et al. ..... 30/43.92
6,568,083 B1 * 5/2003 Taniguchi et al. ..... 30/43.2

FOREIGN PATENT DOCUMENTS

DE 198 32 475 C1 3/2000

* cited by examiner

*Primary Examiner*—Boyer D Ashley
*Assistant Examiner*—Omar Flores-Sánchez
(74) *Attorney, Agent, or Firm*—Chapman and Cutler LLP

(57) ABSTRACT

An electric shaver includes a housing in which an electric drive for cutting knives of a shearing head is arranged. A shearing head frame is held by a first latching device in a position abutting on the housing and, upon release by the first latching device, is movable relative to the cutting knives into a position spaced apart from the housing against a stop. A second latching device is provided, by the release of which the shearing head frame is separately removable irrespective of the shearing head frame position released by the first latching device.

11 Claims, 5 Drawing Sheets

ELECTRIC SHAVER

BACKGROUND OF THE INVENTION

1. Field of the Invention

The invention relates to an electric shaver including a housing in which an electric drive for the cutting knives of a shearing head is arranged, and a shearing head frame which is held in a position abutting on the housing by a first latching means and, upon release by the first latching means, is movable relative to the cutting knives into a position spaced apart from the housing against a stop.

2. Prior Art

A shaver of this type is, for instance, known from U.S. Pat. No. 4,631,825. In that known shaver, an external knife frame is mounted on the upper end of the shaver in a manner so as to be parallelly movable away from the upper end of the external housing by a limited distance in response to the pressing down of a pair of detachable push buttons attached to opposite sides of the external housing. As a result of this movement of the external knife frame relative to the external housing, a gap is formed between the external knife frame and the upper end of the external housing such that shaving residues that have collected about an internal knife portion as well as on the same will be completely removed through the gap when washing the shaver in water.

Another washable electric shaver is known from JP 58-29479, wherein a shearing head frame is articulately connected to one side of the housing by an articulation means so as to be pivotable into an open position. In this manner, the internal cutting knife is uncovered, whereby the uncovered cutting knife is immersed into water and set into an oscillating movement in order to enable shaving residues collected on and about the same to be removed therefrom.

The option to wet-clean electric shavers does, however, not guarantee the safe and complete removal of hair dust, and it can rather be observed that the remaining hair residues will swell by the action of water and that, as a result, germs will be formed to an increasing extent on account of moisture, thus causing unpleasant smells. It is, therefore, still widely common to dry-clean electric shavers, to which end the shearing head frame must be completely removed in order to subsequently clean the individual parts of the cutting system by hand, using a brush or paintbrush. Conventional shavers are, however, designed either for wet cleaning or for dry cleaning, and it is, therefore, not readily feasible for the final consumer to perform either wet cleaning or dry cleaning on one and the same shaver, according to wish.

SUMMARY OF THE INVENTION

The present invention aims to provide an electric shaver which will not restrict the final consumer as to the type of cleaning in any manner whatsoever and which will alternately render feasible in a simple manner both wet cleaning and dry cleaning. The operability of the shaver during cleaning is to be as simple as possible while offering as large a flexibility as possible. To this end, the electric shaver of the initially defined kind according to the invention is designed in a manner that a second latching means is provided, by the release of which the shearing. head frame is separately removable irrespective of the shearing head frame position released by the first latching means.

By providing in addition to a first latching means, by the release of which the shearing head frame is movable into a position spaced apart from the housing against a stop, a second latching means, by the release of which the shearing head frame is separately removable irrespective of the shearing head frame position released by the first latching means, the user may choose between wet cleaning and dry cleaning of the shaver. For the purposes of wet cleaning, it merely suffices to actuate the first latching means such that the shearing head frame in a manner corresponding to the prior art will reach a position spaced apart from the housing and will be held in that position by a stop, which movement will, for instance, result in a gap formed between the shearing head frame and the housing so as to enable shaving residues to be washed off by the aid of water. On the other hand, for the purposes of dry cleaning, it merely suffices to actuate the second latching means so as to enable the shearing head frame to be completely disengaged and removed, thus enabling the cutting knives to be uncovered and cleaned by the aid of a brush or paintbrush. The actuation of the second latching means and complete removal of the shearing head frame according to the invention are feasible in a manner irrespective of the shearing head frame position released by the first latching means, and hence feasible by departing both from a position in which the shearing head frame abuts on the housing and from a position enabling wet cleaning, in which a gap is, for instance, formed between the shearing head frame and the housing. Overall, an electric shaver is thus provided, which offers as large a flexibility as possible in terms of cleaning options. The user may facultatively carry out wet cleaning upon actuation of the first cleaning means or dry cleaning upon actuation of the second latching means, or even both.

In order to enable the shearing head frame to be separately removed upon release by the second latching means in a manner irrespective of the shearing head frame position released by the first latching means, a preferred embodiment in a structurally particularly simple manner contemplates that the second latching means is arranged so as to be displaceable with the shearing head frame. The second latching means in this case is moved together with the shearing head frame, and the release of the second latching means thus enables the shearing head frame to be completely removed both in the original position of the shearing head frame and in the shearing head frame position enabling wet cleaning. In a structurally particularly preferred manner, the configuration in this respect is further developed such that the first latching means is formed by an end face or abutting surface of a movable part arranged on a displaceable slide and a housing counter abutting surface cooperating with said end face or abutting surface, and that the second latching means is formed by a further end face or abutting surface of a further movable part arranged on the displaceable slide and a shearing head frame counter abutting surface cooperating with this end face or abutting surface. According to this configuration, one end face or abutting surface of the first and second latching means is each arranged on a displaceable slide, which thus constitutes sort of a coupling member between the first and second latching means.

In a preferred manner, this configuration is further developed such that the abutting surface of the slide, which cooperates with the abutting surface of the housing, is formed on a spring element, preferably a spring arm, which is capable of being actuated by an actuation button, whereby the abutting surface of the slide, which cooperates with the abutting surface of the shearing head frame, is preferably formed on a resilient latch nose. The displaceable slide thus carries two spring elements, on which one stop of a latching means is each formed and which may be actuated by an actuation element in a manner that a maximum number of functions is altogether realized on a single structural component, namely the displaceable slide, thus enabling a reduction of the number of structural components and hence production costs involved. In a preferred manner, the latch nose in this context is formed on a resilient arm equipped with a head unlatching button.

According to a further preferred embodiment of the shaver according to the invention, the shearing head frame and the displaceable slide are spring-loaded by at least one pressure spring supported in the housing. This ensures the automatic extension of the shearing head frame relative to the housing as soon as the first latching means has been released. In addition, a damping element 24, preferably an oil damper, may preferably be associated with the pressure spring to ensure that the outward movement of the shearing head frame relative to the housing will occur in a controlled fashion rather than with a jerk.

In the main, a first and a second latching means are preferably each arranged on two opposite sides of the shaver. Thus, parallel movement of the shearing head frame relative to the housing will automatically be effected while forming a gap into which water will be introduced for the purposes of wet cleaning.

BRIEF DESCRIPTION OF THE DRAWINGS

In the following, the invention will be explained in more detail by way of an exemplary embodiment schematically illustrated in the drawing. Therein.

DETAILED DESCRIPTION OF A PREFERRED EMBODIMENT OF THE INVENTION

Figure 1:
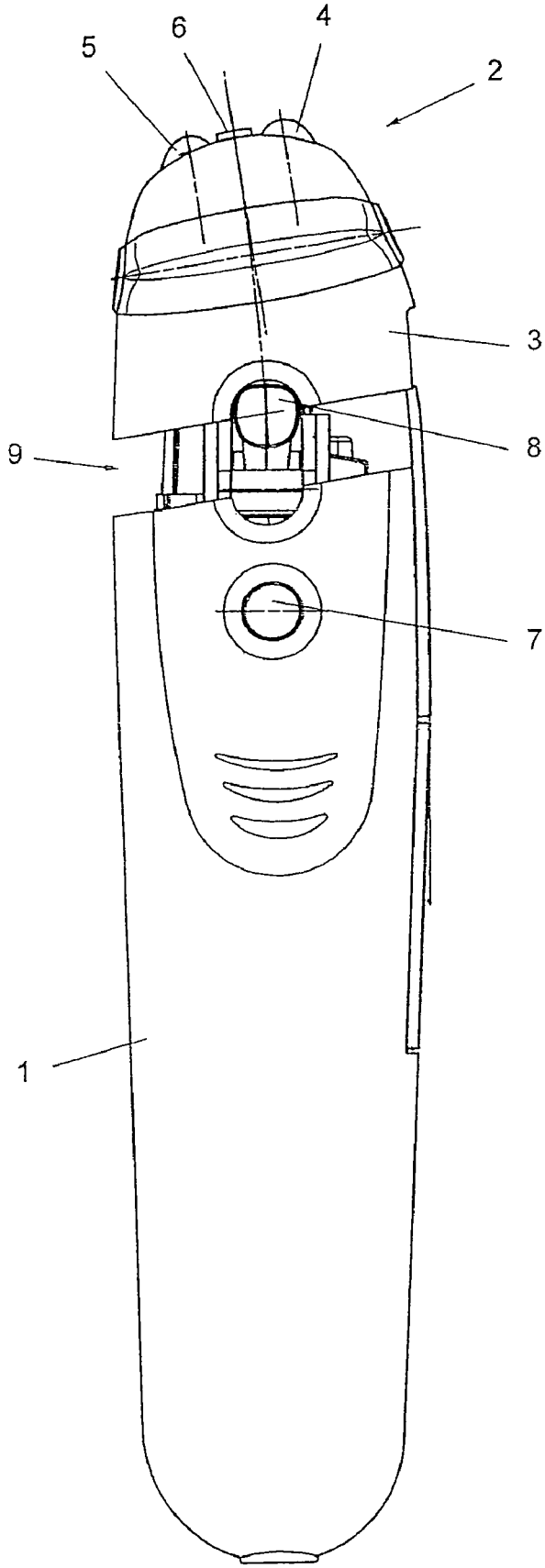
FIG. 1 is a side view of the shaver according to the invention with the shearing head frame being in a spaced-apart relationship relative to the housing.

In FIG. 1, the housing of a shaver is denoted by 1. The shearing head 2 comprises a shearing head frame 3, in which a cutting system comprised of two short-hair cutters 4 and 5 as well as a long-hair cutter 6 is arranged. Two actuation buttons 7 and 8 are illustrated, the shearing head frame 3 in the position represented in FIG. 1 having been displaced into a position spaced-apart relative to the housing 1 upon actuation of the button 7 and release by the first latching means, while forming a gap 9, with the position of the cutting knives as shown in dotted lines in FIG. 7B. This position is also referred to as wet-cleaning position and facilitates the introduction of water to remove hair dust from the shearing head.

Figure 2:
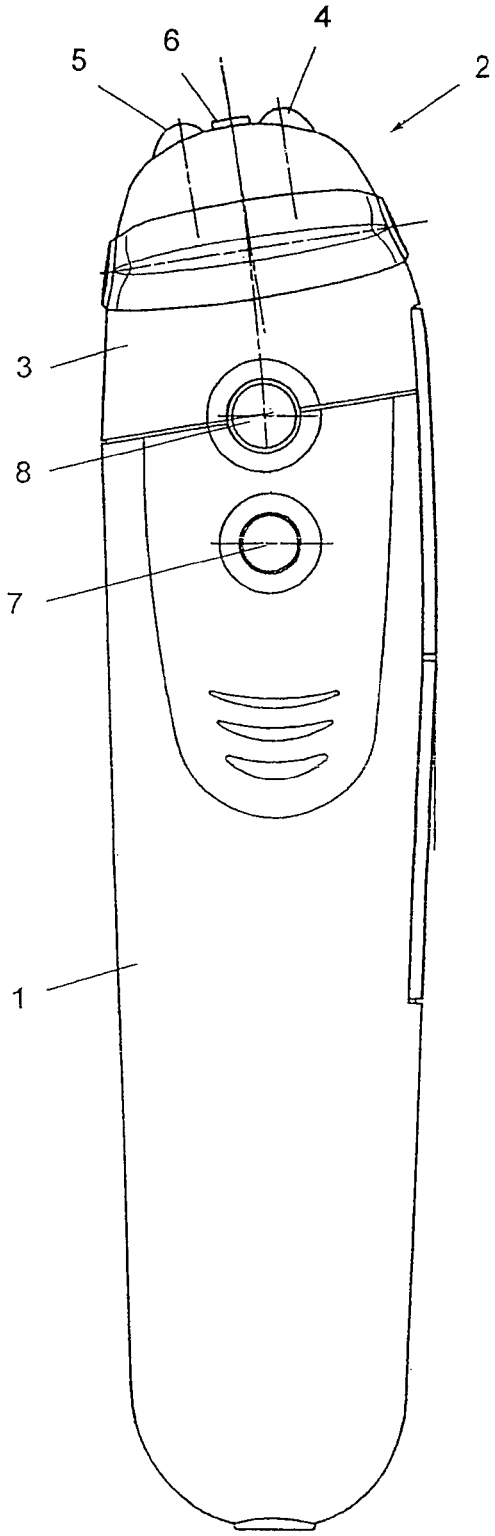
FIG. 2 is a side view with the shearing head frame abutting on the housing.
Figure 3:
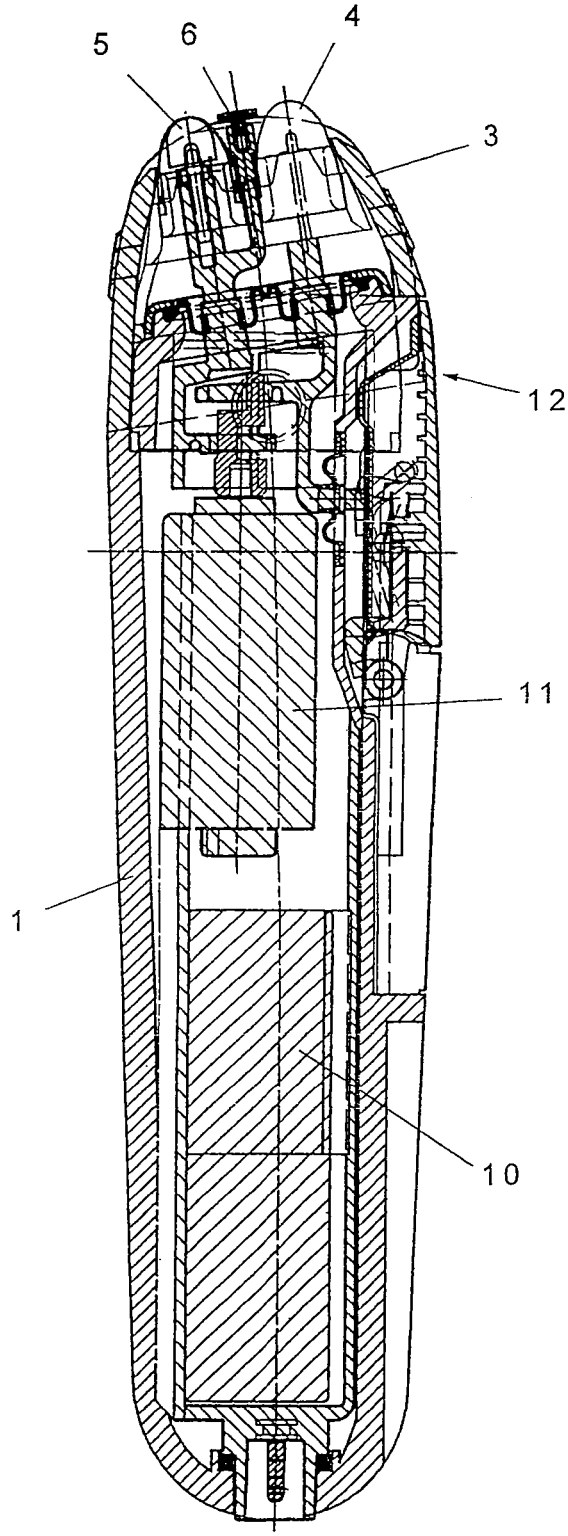
FIG. 3 is a sectional view in the position according to FIG. 2.
Figure 7A:
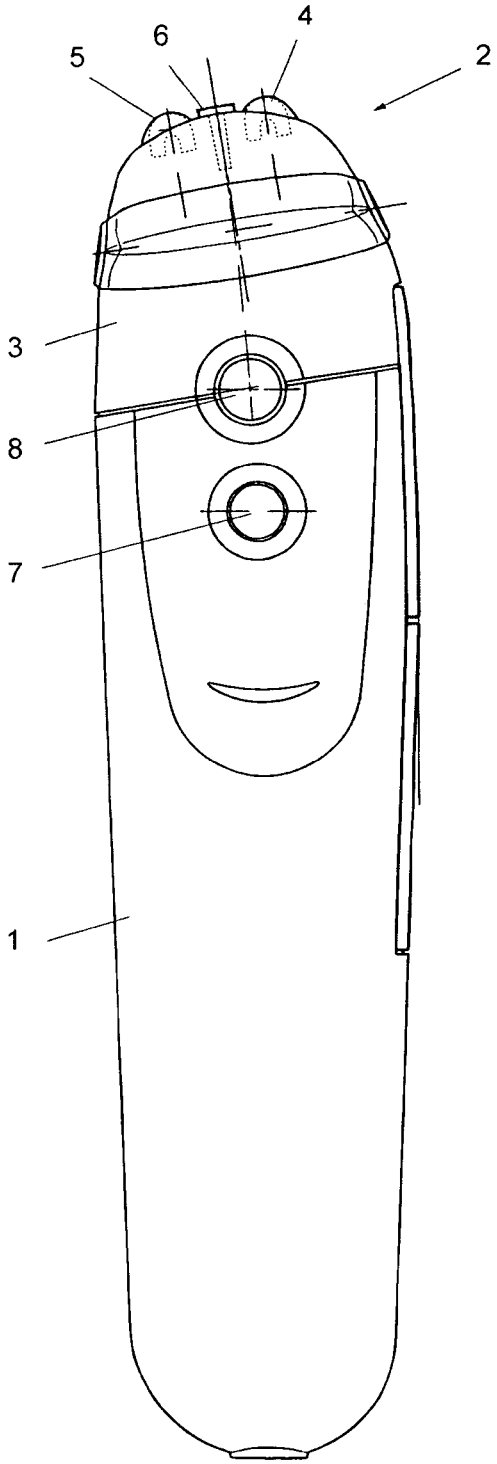
FIGS. 7A and 7B are side views with dotted lines showing the positions of the cutting knives, with FIG. 7A showing the shearing head frame abutting on the housing, and FIG. 7B showing the shearing head frame in a spaced-apart relationship relative to the housing.
Figure 7B:
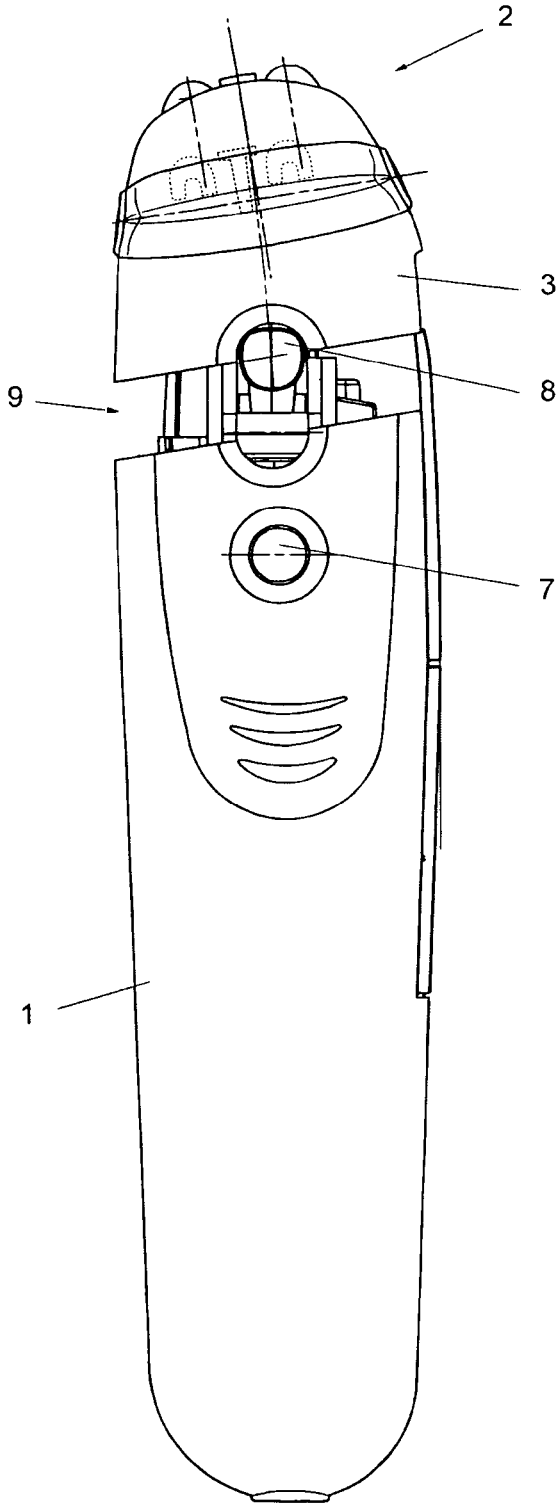

FIG. 2 depicts the shaver in its original position, in which the shearing head frame 3 abuts on the housing 1, with the position of the cutting knives as shown in dotted lines in FIG. 7A. FIG. 3 is the pertinent sectional view, from which a power supply unit 10, a driving unit 11 as well as a trimmer unit 12 capable of being deployed from the plane of the housing 1 are, for instance, apparent.

Figures 4, 5:
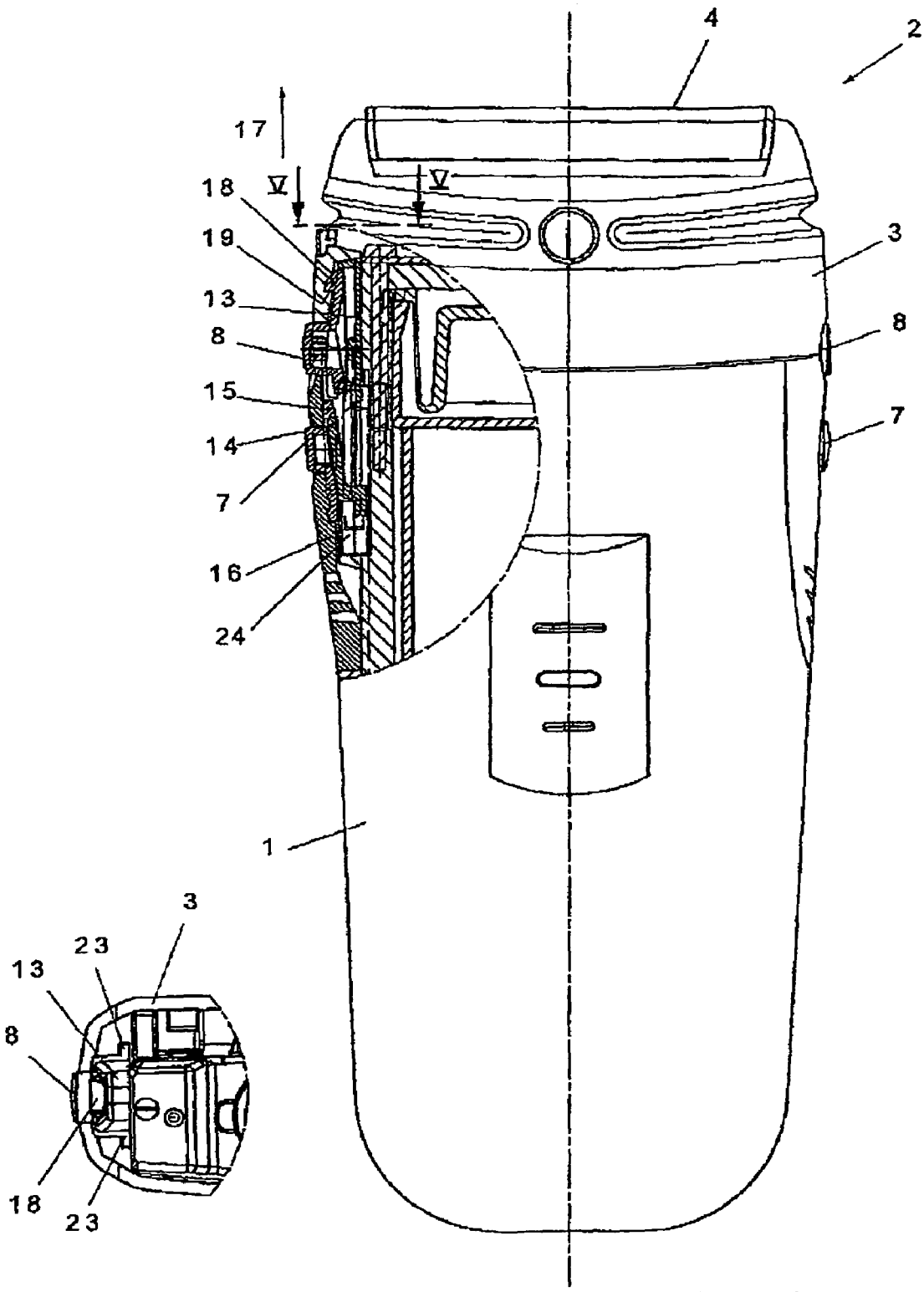
FIG. 4 is a partially sectioned front view in the position according to FIG. 2.
FIG. 5 is a section along line V-V of FIG. 4.

FIG. 4 illustrates the individual latching means in more detail in a partially sectioned view. The first latching means is actuated through the actuation button 7 by the latter acting on a spring arm 14 formed on a slide 13. On the spring arm 14 is formed an abutting surface which cooperates with a counter abutting surface 15 of the housing 1. By actuating the actuation button 7, the spring arm 14 is pressed inwards, thus causing the abutting surface formed on the spring arm 14 to be disengaged from the counter abutting surface 15 of the housing 1 in a manner that the slide 13 will be moved outwards in the sense of arrow 17 by the force of a spring 16. The slide 13 is then connected with the second latching means, which links the slide 13 with the shearing head frame 3. To this end, the slide 13 comprises a resilient latch nose 18 whose abutting surface cooperates with a counter abutting surface 19 of the shearing head frame. In the latched position of the second latching means, an outward movement of the slide 13 will cause the respective outward movement of the shearing head frame in the sense of arrow 17. The second latching means can be released by actuating the head unlatching button 8, whereby the resilient latch nose will be pivoted inwards, thus being disengaged from the counter abutting surface 19 of the shearing head frame 3. In this state, the shearing head frame 3 can be completely removed.

From the sectional view according to FIG. 5, the configuration of the slide 13 is apparent. The resilient latch nose is again denoted by 18 and the head unlatching button is again denoted by 8. The slide 13 is designed to comprise two lateral guide portions 23 whose end faces, which are visible in the sectional view, serve the additional support relative to the shearing head frame 3. On account of this additional support, the latch nose 18 is relieved and prevented from evading in a sense opposite to arrow 17 as the shearing head 2 is being inserted.

Figure 6:
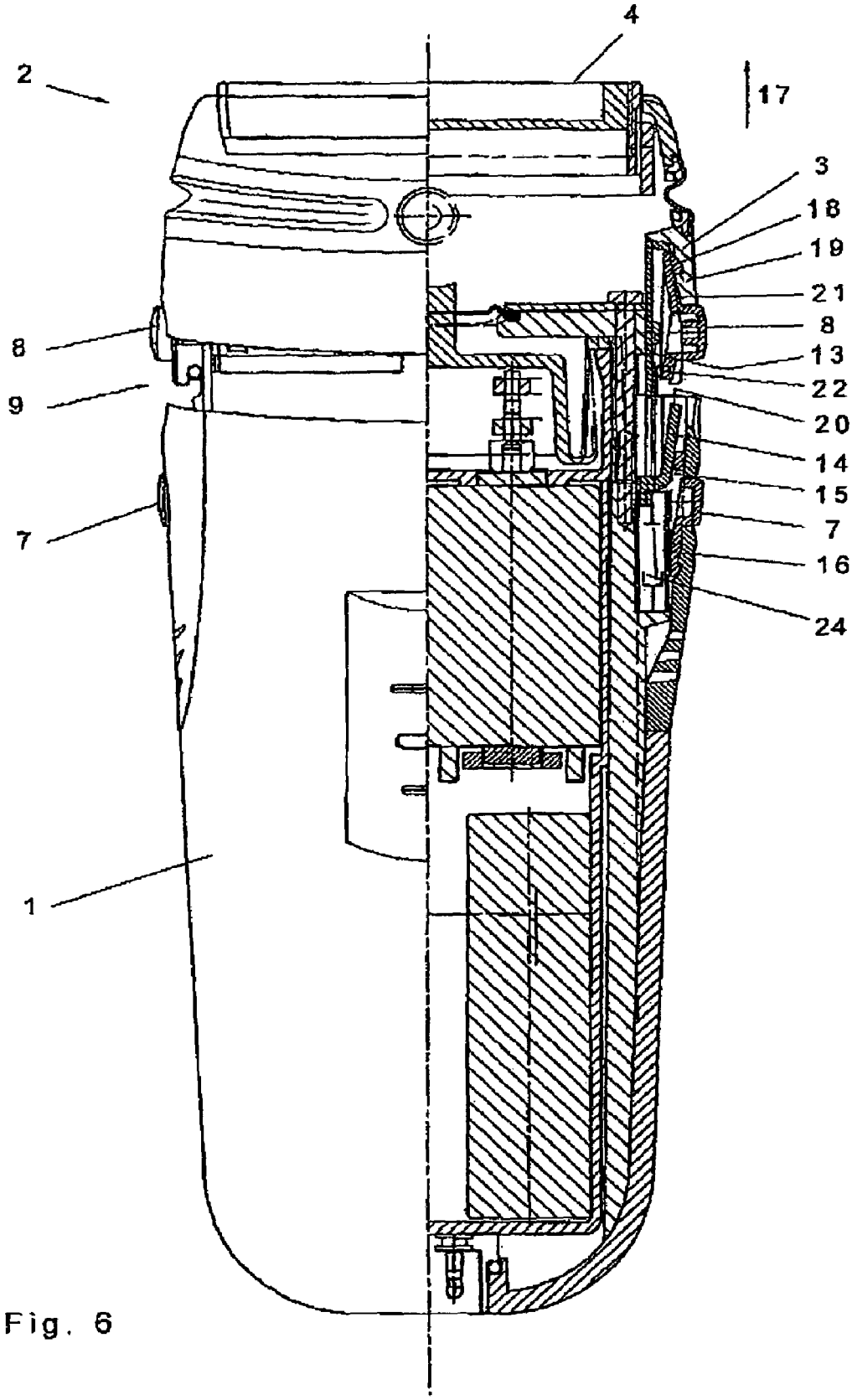
FIG. 6 is a semi-sectioned front view of the shaver in a position according to FIG. 1.

FIG. 6 depicts the first latching means in the released position and the shearing head frame 3 in a position spaced apart from the housing 1. The abutting surface formed on the spring arm 14 is denoted by 20. It is apparent that, in the released position of the first latching means, in which the slide 13, on which the spring arm 14 is formed, has been outwardly displaced in the sense of arrow 17, also the second latching means formed by the latch nose 18 and the associated counter stop 19 of the shearing head frame 3 has been outwardly displaced. The slide 13 in this case constitutes sort of a coupling element between the first and second latching means, whereby the latch nose 18 of the second latching means is formed on a resilient arm 21 equipped with the head unlatching button 8, which arm is connected with the slide 13 in a manner pivotable about an axis 22.

Overall, it is apparent that the first and second latching means can be actuated in a manner independent of each other so as to enable the separate and complete removal of the shearing head frame 3 upon release of the second latching means by the actuation of the head unlatching button 8 and, independently thereof, an outward movement of the shearing head frame 3 against a stop upon release of the first latching means by the actuation of the actuation button 7.

What we claim is:

1. An electric shaver comprising a housing, a shearing head having a shearing head frame, cutting knives mounted on said shearing head, means for electric driving arranged in said housing and constructed to drive said cutting knives, a stop, a first means for latching constructed to hold said shearing head frame in a first position in abutment on said housing and, upon release of said first means for latching, moving said shearing head frame relative to said cutting knives into a second position spaced apart from said housing against said stop, and a second means for latching constructed to enable removal of said shearing head frame, said removal of the shearing head frame being possible when the shearing head frame is in the first position and when the shearing head frame is in the second position.

2. An electric shaver as set forth in claim 1, wherein said second means for latching is displaceable with said shearing head frame.

3. An electric shaver as set forth in claim 1, further comprising a displaceable slide, a first movable part arranged on said displaceable slide and having a first end face or abutting surface, a second movable part arranged on said displaceable slide and having a second end face or abutting surface, a first counter abutting surface provided on said housing, and a second counter abutting surface provided on said shearing head frame, wherein said first means for latching includes said first end face or abutting surface and said first counter abutting surface, and said second means for latching includes said second end face or abutting surface and said second counter abutting surface.

4. An electric shaver as set forth in claim 3, further comprising a spring element constructed to form said first end face or abutting surface provided on said slide and cooperating with said first counter abutting surface provided on said housing, and an actuation button constructed to actuate said spring element.

5. An electric shaver as set forth in claim 4, wherein said spring element is a spring arm.

6. An electric shaver as set forth in claim 3, further comprising a resilient latch nose constructed to form said second end face or abutting surface cooperating with said second counter abutting surface provided on said shearing head frame.

7. An electric shaver as set forth in claim 6, further comprising a resilient arm constructed to form said latch nose, and a shearing head unlatching button provided on said resilient arm.

8. An electric shaver as set forth in claim 3, further comprising at least one pressure spring supported in said housing and constructed to spring-load said shearing head frame and said displaceable slide.

9. An electric shaver as set forth in claim 8, further comprising a damping element associated with said pressure spring.

10. An electric shaver as set forth in claim 9, wherein said damping element is an oil damper.

11. An electric shaver as set forth in claim 1, wherein a first means for latching and a second means for latching are each arranged on two opposite sides of said shaver.

* * * * *